US010342284B2

(12) United States Patent
Parisotto

(10) Patent No.: US 10,342,284 B2
(45) Date of Patent: Jul. 9, 2019

(54) SKI BOOT

(71) Applicant: CALZATURIFICIO S.C.A.R.P.A. S.p.A., Asolo (IT)

(72) Inventor: Davide Parisotto, Casella d'Asolo (IT)

(73) Assignee: Calzaturificio S.C.A.R.P.A S.p.A., Asolo (IT)

( * ) Notice: Subject to any disclaimer, the term of this patent is extended or adjusted under 35 U.S.C. 154(b) by 82 days.

(21) Appl. No.: 15/405,629

(22) Filed: Jan. 13, 2017

(65) Prior Publication Data

US 2017/0202297 A1 Jul. 20, 2017

(30) Foreign Application Priority Data

Jan. 15, 2016 (IT) ..... 102016000003496

(51) Int. Cl.
*A43B 5/04* (2006.01)
*A43C 11/16* (2006.01)
(Continued)

(52) U.S. Cl.
CPC ..... *A43B 5/0476* (2013.01); *A43B 5/04* (2013.01); *A43B 5/0405* (2013.01); *A43B 5/045* (2013.01); *A43B 5/047* (2013.01); *A43B 5/049* (2013.01); *A43B 5/0411* (2013.01); *A43B 5/0435* (2013.01); *A43B 5/0443* (2013.01); *A43B 5/0447* (2013.01); *A43C 11/008* (2013.01); *A43C 11/12* (2013.01); *A43C 11/165* (2013.01)

(58) Field of Classification Search
CPC ... A43B 5/0405; A43B 5/0435; A43B 5/0443; A43B 5/0447; A43B 5/045; A43C 11/165
USPC ..... 36/50.5, 117.9
See application file for complete search history.

(56) References Cited

U.S. PATENT DOCUMENTS 5,001,851 A * 3/1991 Baggio ..... A43B 5/0447 36/117.9
5,177,882 A * 1/1993 Berger ..... A43B 1/0072 36/50.1

(Continued)

FOREIGN PATENT DOCUMENTS

| | | | |
|---|---|---|---|
| EP | 0783844 | A2 | 7/1997 |
| FR | 2734690 | A1 | 12/1996 |
| WO | 2015/038946 | A1 | 3/2015 |

OTHER PUBLICATIONS

Search Report and Written Opinion dated Aug. 31, 2016 from Italian Patent No. UB20160158 filed Jan. 15, 2016.

*Primary Examiner* — Sharon M Prange
(74) *Attorney, Agent, or Firm* — David B. Tingey; Bryant J. Keller; Kirton McConkie

(57) ABSTRACT

Ski boot comprising a rigid shell which is shaped so as to accommodate the foot of the user, and has a lower part structured to couple with a ski binding device; a rigid cuff which is shaped so as to surround the lower part of the leg of the user, and is pivotally jointed to the shell thus to be able to pivot about a rotation axis substantially perpendicular to the midplane of the boot, and shell closing means adapted to selectively tighten the shell on the foot of the user; the shell comprising a substantially basin-shaped casing which is superiorly provided with a main opening from which the leg of the user comes out, and with a longitudinal slit that branches from said main opening and extends along the casing towards the front tip of the shell; the shell closing means being placed at the longitudinal fissure.

12 Claims, 3 Drawing Sheets

(51) Int. Cl.
*A43C 11/00* (2006.01)
*A43C 11/12* (2006.01)

(56) References Cited

U.S. PATENT DOCUMENTS

| | | | | |
|---|---|---|---|---|
| 5,177,884 | A * | 1/1993 | Rullier | A43B 5/0411 36/114 |
| 5,778,563 | A * | 7/1998 | Ahlbaumer | A43B 5/00 36/140 |
| 6,779,283 | B2 * | 8/2004 | Gabrielli | A43B 5/04 36/115 |
| 7,082,701 | B2 * | 8/2006 | Dalgaard | A43B 5/0401 36/50.1 |
| 7,428,789 | B2 * | 9/2008 | Holzer | A43B 5/0411 36/117.2 |
| 2003/0177662 | A1 * | 9/2003 | Elkington | A43C 1/00 36/50.1 |
| 2004/0226190 | A1 | 11/2004 | Elkington et al. | |
| 2015/0342304 | A1 * | 12/2015 | Modena | A43B 5/0401 36/115 |
| 2018/0110294 | A1 * | 4/2018 | Schneider | A43B 23/0245 |

* cited by examiner

SKI BOOT

PRIORITY CLAIM

This application claims priority from Italian Patent Application No. 102016000003496 filed on Jan. 15, 2016, the disclosure of which is incorporated by reference.

TECHNICAL FIELD

The present invention relates to a ski boot.

More in detail, the present invention relates to a ski boot for ski mountaineering, use to which the flowing description will make explicit reference without thereby losing in generality.

BACKGROUND OF THE INVENTION

As is known, ski boots for ski mountaineering currently on the market basically comprise: a rigid shell made of plastic or composite material, which is shaped so as to accommodate the foot of the user, and has the lower part specifically structured so as to be fixed to the back of a downhill ski or similar by means of a special ski binding device; a rigid cuff made of plastic or composite material, which is shaped so as to embrace the lower part of the leg of the user from the behind, and is hinged to the upper part of the shell so as to be able to rotate about a transversal reference axis which is substantially perpendicular to the vertical midplane of the boot, and is also locally substantially coincident with the articulation axis of the ankle; an upper oblong tongue usually made of plastic material, which is arranged resting on the upper part of the shell, outside of the shell, so as to cover the longitudinal slit which extends straddling the midplane of the boot, in the area of the shell above the instep; and an inner liner in soft, thermal-insulating material, which is inserted inside the shell and the cuff, and is shaped so as to receive and protect both the foot and the lower part of the user's leg.

In addition the above-mentioned ski boots comprise a shell closing mechanism and a cuff closing mechanism, both manually operated.

In the more sophisticated models, the shell closing mechanism usually comprises: a manually-operated cable-winding winch which is rigidly fixed on the upper side of the tongue with the winch rotation axis locally substantially perpendicular to the surface of the tongue; a number of fairlead elements which are attached rigidly to the shell, on opposite sides of the longitudinal slit of the latter; and lastly a flexible cable made of metal material, which comes out of the cable-winding winch, slidingly engages in succession the various fairlead elements present on the shell passing alternately from one side of the shell longitudinal slit to the other above the tongue, and lastly returns back inside the cable-winding winch.

Despite working excellently, experimental tests have shown that, when used in conjunction with a shell composed of one or more overlapping layers of carbon fibres embedded in the resin, the above-described winch lacing system has a very limited capability to tighten the shell onto the foot of the user so that the shape of the composite-material shell must be almost tailor-made for the user, with all the drawbacks that this entails.

To better meet the market demands, the manufacturer of ski mountaineering boots must produce the composite-material shells in a larger number of sizes, with the increased costs that this entails.

SUMMARY OF THE INVENTION

Aims of the present invention is to realise a shell closing system which overcomes the drawbacks described above, possibly without increasing the overall production costs of the ski boot.

In compliance with the above aims, according to the present invention there is provided a ski boot as defined in Claim 1 and preferably, though not necessarily, in any of the dependent claims.

BRIEF DESCRIPTION OF THE DRAWINGS

The present invention will now be described with reference to the accompanying drawings, which illustrate a non-limiting embodiment thereof, in which:

FIG. 2 is a perspective and partially exploded view of the lower part of the ski boot shown in FIG. 1, with parts removed for clarity; while

DETAILED DESCRIPTION OF THE INVENTION

Figure 1:
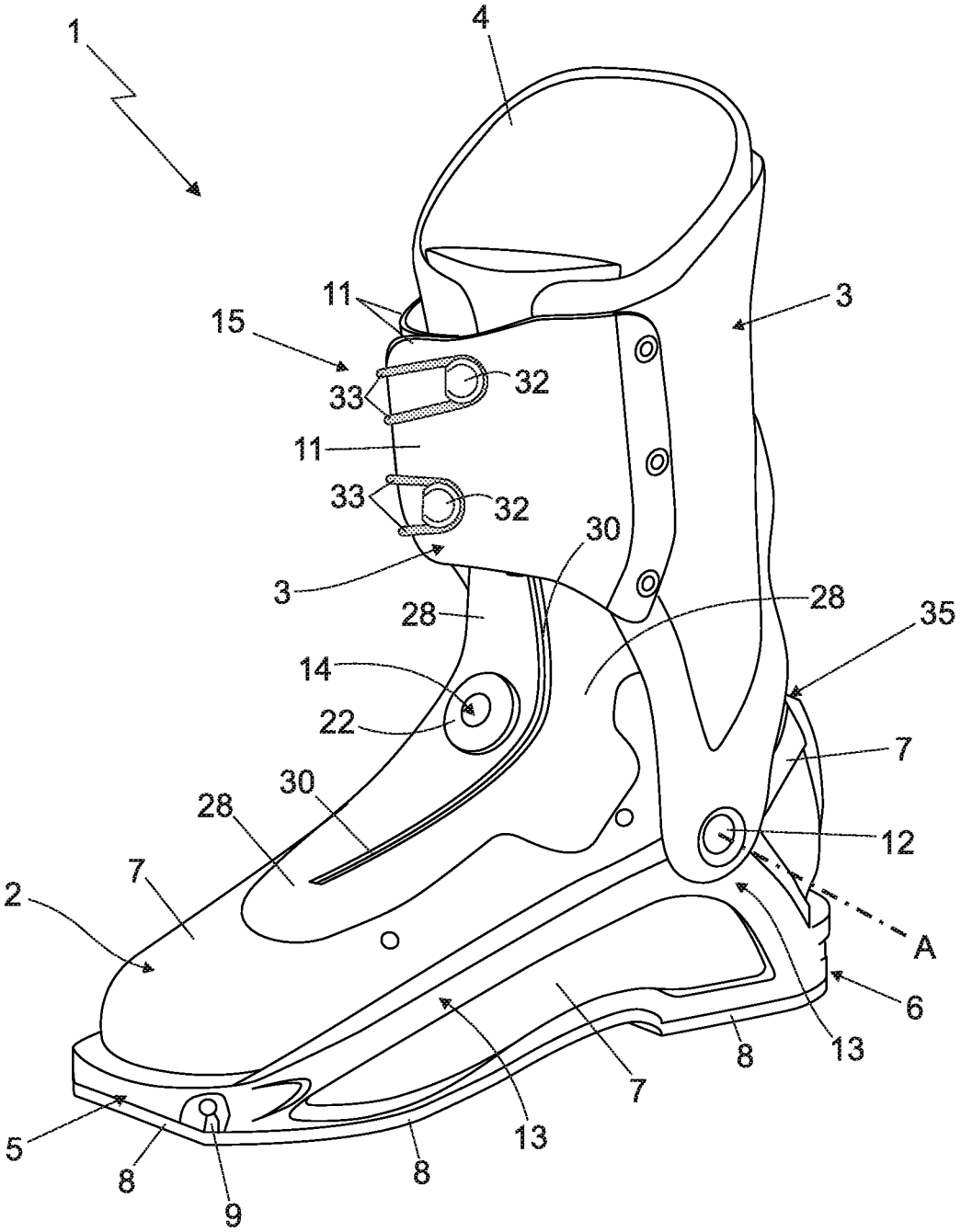
FIG. 1 is a perspective view of a ski boot realized according to the teachings of the present invention.
Figure 2:
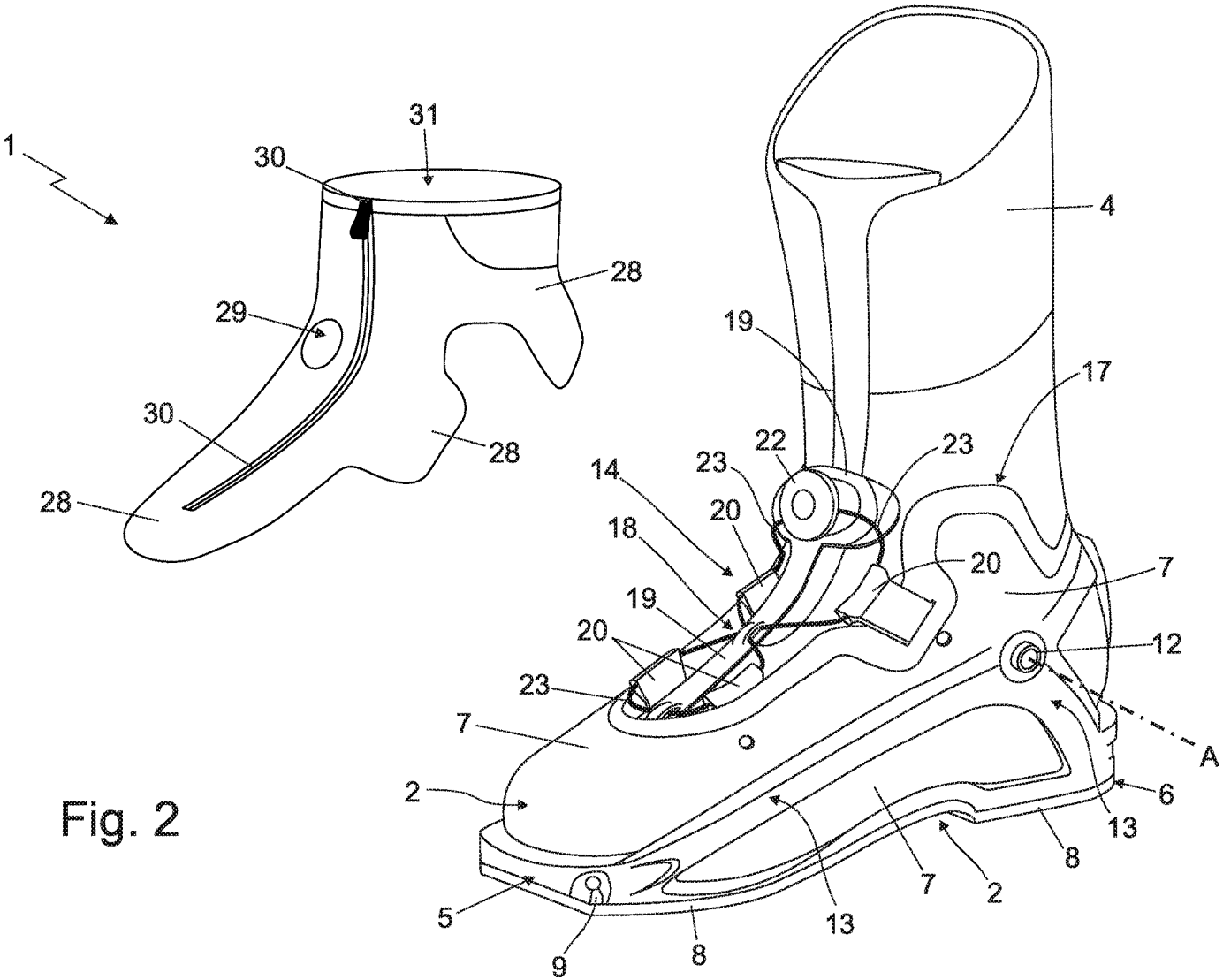
Figure 3:
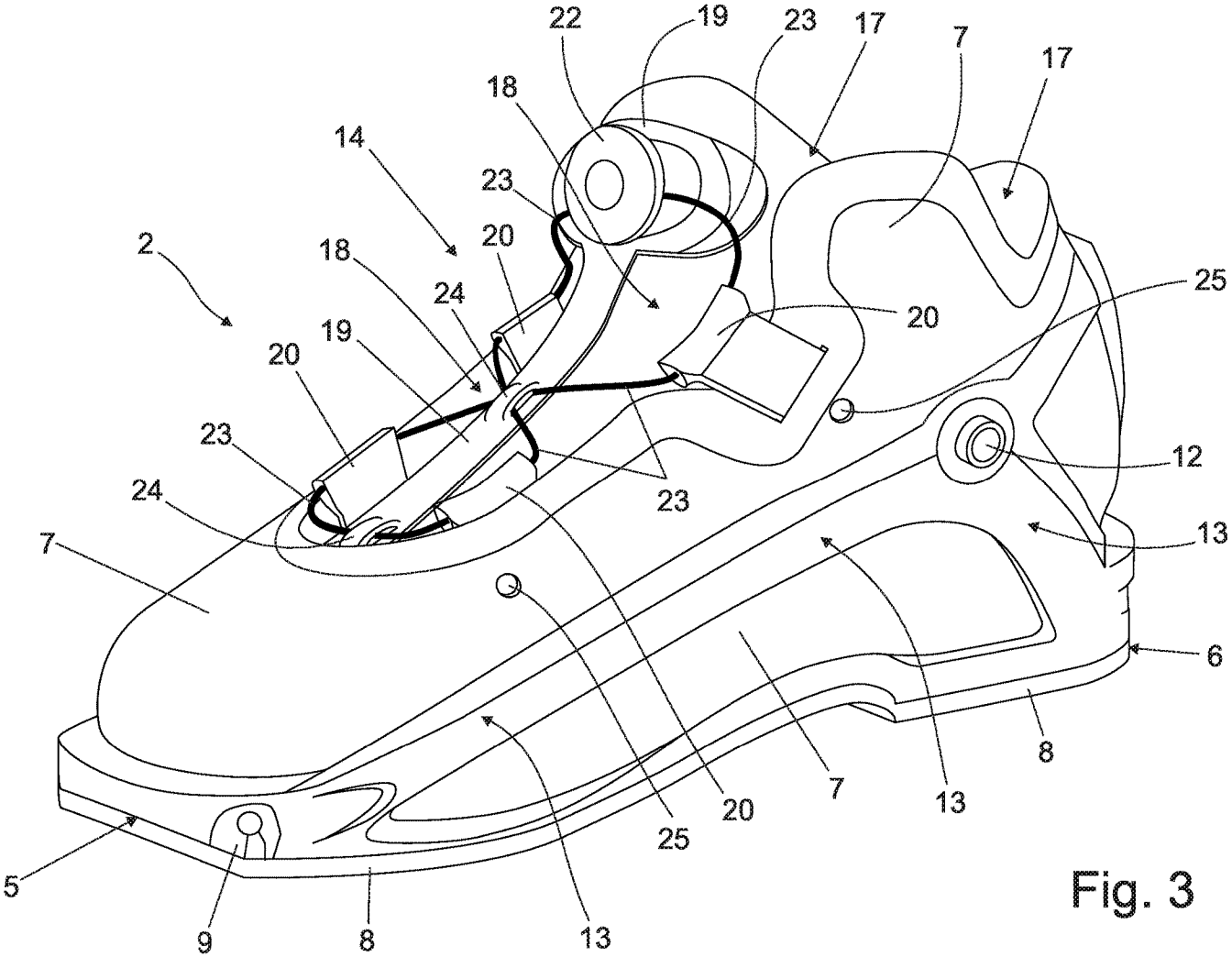
FIG. 3 is an enlarged view of the shell of the ski boot shown in FIG. 2, with parts removed for clarity.

With reference to FIGS. 1, 2 and 3, reference number 1 denotes as a whole a ski boot which may be advantageously used to practise ski mountaineering.

Ski boot 1 firstly comprises: a rigid shell 2 which is shaped so as to accommodate the user's foot and has the lower part specifically structured/designed to couple/connect in a rigid and stable, though easily releasable manner, to a ski binding device (not shown) of known type which, in turn, is adapted to be rigidly fixed to the back of a downhill ski or similar; and a rigid cuff 3 which is shaped so as to enclose the lower part of the leg of the user, and is hinged to the upper part of shell 2 so as to be able to freely pivot about a transversal rotation axis A, which is locally substantially perpendicular to the vertical midplane of the ski boot and is also substantially coincident with the articulation axis of the user's ankle.

More in detail, the lower part of shell 2 is preferably provided with a front tip 5 and rear heel 6. The front tip 5 is preferably structured so as to be able to couple/connect in a stable, though easily releasable manner to the toe piece (not shown) of a ski binding device which, in turn, is firmly fixed to the back of a generic downhill ski or similar. The rear heel 6 instead is preferably structured so as to be able to couple/connect in a stable, though easily releasable manner to the heel piece (not shown) of a ski binding device which, in turn, is firmly fixed to the back of a generic downhill ski or similar.

In the example shown, in particular, the front tip 5 of shell 2 is preferably structured so as to be able to couple/connect in a stable, though easily releasable manner to the toe piece of a ski-mountaineering binding device; whereas the rear heel 6 of shell 2 is preferably structured so as to be able to couple/connect in a stable, though easily releasable manner, to the heel piece of the same ski-mountaineering binding device.

Preferably, the lower part of shell 2 additionally has a threaded profile so as to allow the user to walk on snow and ice.

In addition, the ski boot 1 moreover comprises an inner liner 4 with a soft and thermal-insulating structure, optionally of the thermoformable type, which is inserted into shell 2 and optionally also into cuff 3 preferably, though not necessarily in removable manner. The inner liner 4 is shaped so as to accommodate, cover and protect the user's foot substantially up to the ankle and optionally also the lower part of the user's leg roughly up to the top of the calf.

With reference to FIGS. 1, 2 and 3, shell 2 comprises a substantially basin-shaped, rigid casing 7 which is made of plastic or composite material and is designed substantially like a shoe so as to cover and protect the user's foot substantially up to the ankle; and preferably also a bottom sole 8 which is preferably made of vulcanized rubber or other elastomeric material with a high friction coefficient, and is firmly attached to the bottom wall of casing 7 preferably by glueing.

In the example shown, in particular, casing 7 is preferably made of PEBAX (polyester-amide), Nylon (polyamide) or other similar plastic polymer.

In an alternative embodiment, however, casing 7 might also be made of a composite material preferably made up of one or more overlapping layers of carbon fibres and/or glass fibres and/or aramid fibres, suitably interwoven and/or superimposed to one another and embedded in a matrix of epoxy, phenolic or polyester resin, preferably of thermosetting type.

Preferably shell 2 furthermore comprises a first metal-material insert 9, which is firmly embedded/incorporated in the bottom wall of casing 7 at the front tip 5 of shell 2, and is structured so as to emerge outside of the casing 7 on opposite sides of the midplane of the boot, so as to be able to couple/connect in known manner to the toe piece (not shown) of the ski-mountaineering binding device; and optionally also a second metal-material insert (not visible in the figures) which is instead recessed into the casing 7 at the heel 6, and is structured so as to be able to couple/connect in a known manner to the heel piece (not shown) of the same ski-mountaineering binding device.

With reference to FIG. 1, preferably cuff 3 instead consists basically of a rigid shell made of plastic or composite material and which is substantially C-bent so as to cover the rear part of the user's leg, from the ankle substantially up to the height of the calf, and is additionally provided with two oblong lateral flaps 11 which extend forwards from opposite sides of the midplane of the boot, so as to embrace from behind the user's leg roughly at the height of the calf, and then overlap to one another at the front of the leg, thus forming a tubular structure that encloses the user's leg at height of the calf.

Cuff 3, furthermore, is preferably fixed in free rotatable manner to the upper part of shell 2, or rather of casing 7, by means of two connecting hinges 12 preferably made of metal and which are placed on the inner and outer side walls of shell 2 and of cuff 3, aligned along axis A, so as to allow the cuff 3 to freely rotate on the shell 2 both forwards and backwards, while always remaining on a reference plane perpendicular to axis A and substantially coinciding with the midplane of the ski boot.

In the example shown, moreover, the rigid casing 7 preferably presents, on each side wall of shell 2, a long longitudinal stiffening rib 13 which has an arched or roughly L-formed shape, and extends along the side wall of shell 2 so as to connect the rear heel 6 to the front tip 5 preferably simultaneously intersecting the axis A, i.e. the seat accommodating the connecting hinge 12.

With reference to FIGS. 1, 2 and 3, in addition the ski boot 1 is also provided with shell closing means 14 and cuff closing means 15, both manually operated.

The shell closing means 14 are structured so as to selectively close/tighten the shell 2, or rather the casing 7, against the user's foot to immobilize the user's foot inside the shell 2, or rather the inner liner 4.

The cuff closing means 15, instead, are structured so as to selectively close/tighten the upper part of the cuff 3 against the user's leg, so as to immobilize the user's leg inside the shell 3, or rather the inner liner 4.

More in detail, with reference to FIGS. 2 and 3, the upper part of casing 7 is provided with a main opening/mouth 17 from which the user's leg comes out, and with an oblong-shaped, auxiliary longitudinal slit 18 that branches from the main opening 17 and extends towards the front tip 5 of shell 2 along the area of casing 7 lying above the instep, while remaining substantially astride the midplane of the boot.

The shell closing means 14 are placed at the longitudinal slit 18, and comprise:

- a rigid floating body 19 which is preferably made of plastic or composite material and is suspended substantially at the centre of the longitudinal slit 18 so as to extend like a saddle over the instep of foot of the user, preferably also resting against the upper part of inner liner 4;
- a plurality of flexible oblong tabs 20, which are firmly secured to the casing 7 around the longitudinal slit 18, and cantilevered project into the longitudinal slit 18 towards the rigid floating body 19, preferably while remaining locally skimmed over the inner liner 4 beneath;
- a manually operated, winch-type cable-winding assembly 22 which is rigidly fixed to the rigid floating body 19, above the latter; and
- a flexible cable 23 preferably made of metal material and which comes out of the cable-winding assembly 22, engages in pass-through and free sliding manner and in succession the distal ends of the various flexible tabs 20 moving alternately from one side of the floating body 19 to the other, and preferably then returns back into the cable-winding assembly 22.

The distal ends of flexible tabs 20 are structured so as to allow the flexible cable 23 to freely slide within the same tabs; while the winch-type cable-winding assembly 22 is structured so as to be able to selectively wind the flexible cable 23 inside itself, firmly block the flexible cable 23, and lastly unwind the flexible cable 23.

The winch-type cable-winding assembly 22 is thus able to tighten and keep taut the flexible cable 23, thus forcing the flexible tabs 20 and, as much as possible, also the casing 7 to flex towards the floating body 19, i.e. towards the centre of the longitudinal slit 18, so as to immobilize the user's foot inside the shell 2, or rather the inner liner 4.

With particular reference to FIGS. 2 and 3, in the example shown, in particular, the rigid floating body 19 has a preferably substantially plate-like structure, and the winch-type cable-winding assembly 22 is located on the upper face of the rigid floating body 19, preferably close to the main opening 17 of casing 7.

Preferably the rigid floating body 19 is additionally oblong in shape, and extends substantially straddling the centerline of longitudinal slit 18, resting on the upper part of the inner liner 4 for its entire length. Preferably the rigid floating body 19 is additionally substantially saddle-shaped so as to follow/copy the profile of the upper part of inner liner 4 covering the instep of the user's foot.

In addition, the rigid floating body 19 is preferably engaged in pass-through and free sliding manner by one or more sections of the flexible cable 23.

More specifically the upper face of rigid floating body 19 is preferably provided with one or more cable-pass bridges 24 (two bridges 24 in this example) each of which is preferably located substantially straddling the midplane of the boot, and is engaged in a pass-through and free sliding manner by the flexible cable 23.

In an alternative embodiment, however, the flexible cable 23 might also extend from side to side of the rigid floating body 19 grazing the upper face of the latter.

In other words, the rigid floating body 19 could be passed over at the top by one or more sections of the flexible cable 23.

With particular reference to FIG. 3, instead, the flexible tabs 20 are preferably arranged in pairs on opposite sides of the centerline of the longitudinal slit 18, and preferably project cantilevered beyond the edge of the casing 7 and towards the rigid floating body 19 while remaining locally skimmed over the casing 7 and/or the upper part of inner liner 4.

In addition, the distal end of each flexible tab 20 is preferably provided with a transversal through hole which is engaged in a pass-through and free sliding manner by a corresponding section of the flexible cable 23.

Preferably flexible tabs 20 are additionally made of plastic material, and are preferably rigidly fixed to the casing 7, inside the same casing 7.

More specifically, the proximal ends of the flexible tabs 20 are preferably rigidly attached to the inner surface of the casing 7.

In the example shown, in particular, the proximal ends of the flexible tabs 20 are preferably rigidly attached to the lateral walls of casing 7 by rivets 25 or other mechanical attachment members.

In an alternative embodiment, however, the proximal ends of the flexible tabs 20 may also be snapped or heat-welded directly onto the lateral walls of the casing 7.

The winch-type cable-winding assembly 22 and flexible cable 23 are components already widely known and used in the footwear industry, and do not require further explanations since they are extensively described and illustrated, for example, in the patent applications US19970917056, WO1998US16314, JP20000507254, US20010956601, US20010099566, US19990337763, JP20010519784, WO2000US19440, US19990388756, US20010993296, US20030459843, US20050263253, US20070841872, US20070842009, US20070841997, US20070842013, US20070842005, WO2005US39273 and US20040623341P. Documents to which direct reference is to be made for any further details on the structure and/or cable-winding assembly 22.

In the example shown, in particular, winch-type cable-winding assembly 22 and flexible cable 23 are preferably made by the US company BOA TECHNOLOGY INC.

With reference to FIGS. 1 and 2, preferably the shell 2 moreover comprises a protective gaiter 28 roughly tubular in shape, which is preferably made of a waterproof and optionally stretch material, and is placed on the upper part of casing 7 so as to completely close/cover the longitudinal slit 18 of casing 7 and then extend upward aligned above the main opening 17 of casing 7, so as to surround and cover the ankle of the user and optionally the lower part of the leg of the user, preferably roughly up to the height of the calf. Preferably the gaiter 28 moreover extends up the user's leg while remaining below the cuff 3.

More specifically, the lower part of the gaiter 28 is preferably irremovably and/or fluid-tight attached to the upper part of casing 7, preferably by welding or gluing.

Preferably the lower part of gaiter 28 is additionally suitable to at least partly cover the shell closing means 14.

In other words, with particular reference to FIGS. 1 and 2, the lower part of gaiter 28 has an oblong flap completely covering/closing the longitudinal slit 18 of casing 7, and also extends above the rigid floating body 19, the flexible tabs 20, the flexible cable 23 and at least partially the winch-type cable-winding assembly 22.

More specifically, the winch-type cable-winding assembly 22 is preferably rigidly fixed onto the floating body 19 below the gaiter 28, and in addition projects cantilevered above the gaiter 28 engaging in pass-through manner a small, complementary-shaped auxiliary opening 29 specifically formed on the area of the gaiter 28 which lies immediately above the floating body 19.

With reference to FIGS. 1 and 2, lastly the shell 2 is preferably additionally provided with a longitudinal zipper 30 preferably of the watertight type, which extends along the gaiter 28, from the area above the instep up to the upper opening 31 of gaiter 28 preferably flanking the auxiliary opening 29, and is structured so as to allow easy and rapid opening of the gaiter 28 to allow/facilitate the insertion of the user's foot inside the inner shoe 4.

With reference to FIG. 1, the cuff closing means 15 instead are at least partially located on cuff 3, and are selectively able to pull the two oblong side flaps 11 of cuff 3 one towards the other, so as to be able to tighten the upper part of cuff 3 onto the user's leg to immobilize the user's leg inside the ski boot 1, or rather the inner liner 4.

In the example shown, in particular, the cuff closing means 15 preferably comprise:

- two cable-return members 32, which are located on a first side flap 11 of cuff 3 vertically spaced one beside the other;
- a tightening cable 33, which has both ends firmly attached to the cuff 3, directly on or close to the second side flap 11 of cuff 3, and extends towards the first side flap 11 roughly grazing the surface of the second side flap 11, so as to be able to reach and engage in free sliding manner and in succession the two cable-return members 32 following a substantially U-shaped path; and lastly
- a manually-operated cable tightening device (not visible in the figure), which is coupled or couple-able to the tightening cable 33 in a coupling point located along the central section of the tightening cable 33, and is able to pull the central section of the cable transversely to the straight line joining the two cable-return members 32, so as to tighten the tightening cable 33 and pull the two oblong side flaps 11 of cuff 3 one towards the other.

With reference to FIG. 1, preferably the ski boot 1 is lastly also provided with a manually-operated or automatic cuff locking device 35 which is preferably located straddling the shell 2 and the cuff 3 in the area above the heel of the ski boot 1, and is structured so as to be able, selectively and alternatively

- to rigidly block the cuff 3 to the shell 2 so as to prevent any swivel movement of the cuff 3 on the shell 2; or
- fully unlock/release the cuff 3 from the shell 2 so as to allow the cuff 3 to freely swing backwards and forwards on the shell 2 around axis A, while remaining on the midplane of the boot.

Operation of ski boot 1 is easily inferred from the description above, and does not need further explanations.

As regards instead operation of the shell closing means 14, the tightening of flexible cable 23 forces the flexible tabs 20 to flex towards the floating body 19, i.e. towards the centre of the longitudinal slit 18, firmly pressing the foot of the user against the bottom of shell 2, or rather against the bottom of casing 7.

The advantages resulting from the particular structure of the shell closing means 14 are remarkable.

Firstly, the shell closing means 14 lend themselves to be used in conjunction with a casing 7 made of highly rigid composite material, because the capability to immobilize the foot of the user inside the shell 2, or rather the inner liner 4, is not affected, except to a minor extent, by the stiffness of casing 7.

The flexible tabs 20 in fact allow to directly embrace the upper part of user's foot and therefore permit to more effectively immobilize the user's foot inside the shell 2, or rather the inner liner 4.

In addition, the presence of flexible tabs 20 makes it possible to push/press the user's foot down against the bottom of the shell 2, or rather against the bottom of the basin-shaped casing 7, significantly improving the comfort of fit and the ability to transmit, during use, the forces to the skier.

Lastly, the particular structure of the shell closing means 14 makes it possible to eliminate the tongue that is traditionally placed to cover the longitudinal slit 18 of casing 7, allowing a small reduction in the overall weight of the ski boot.

Finally, changes and variations may be clearly made to the ski boot 1 described above without, however, departing from the scope of the present invention.

For example, the flexible tabs 20 can be over-injected directly onto the body of casing 7 during the injection moulding process of the casing 7.

The invention claimed is:

1. A ski boot comprising:

a rigid shell which is shaped so as to accommodate a foot of a user, and has a lower part structured to couple with a ski binding device;

a rigid cuff which is shaped so as to surround the lower part of a leg of the user, and is pivotally jointed to the shell thus to be able to pivot about a rotation axis substantially perpendicular to the midplane of the boot, and shell closing means adapted to selectively tighten the shell on the foot of the user;

the shell comprising a substantially basin-shaped casing which is superiorly provided with a main opening that is configured to receive the leg of the user, and with a longitudinal slit that branches from said main opening and extends along the casing towards the front tip of the shell;

the ski boot being characterised in that the shell closing means are located at the longitudinal slit and comprise:

a rigid floating body which is suspended substantially at the center of the longitudinal slit so as to extend like a saddle over the instep of foot of the user; a plurality of flexible tabs which are firmly secured to the casing around the longitudinal slit and cantilevered project into the longitudinal slit;

a winch-type cable-winding assembly which is fixed on the rigid floating body; and a flexible cable that comes out of the cable-winding assembly and engages, in pass-through and free sliding manner and in succession, the distal ends of the various flexible tabs while moving alternately from one side to the other of the rigid floating body;

wherein the shell further comprises a protective gaiter which is located on the upper part of the casing, so as to close the longitudinal slit of the casing and then extend upwards over the main opening of the casing thus configured to surround and cover the ankle of the user;

wherein said gaiter extends over the rigid floating body, the flexible tabs and the flexible cable; and the winch-type cable-winding assembly protrudes above said gaiter engaging in pass-through manner an auxiliary opening realized on the gaiter.

2. The ski boot according to claim 1, characterised in that the rigid floating body is oblong in shape and extends substantially straddling the centerline of the longitudinal slit.

3. The ski boot according to claim 1, characterised in that the rigid floating body is engaged in pass-through and free sliding manner by one or more sections of the flexible cable, or is passed over by one or more sections of the flexible cable.

4. The ski boot according to claim 1, characterised in that the rigid floating body has a substantially plate-like structure, and the winch-type cable-winding assembly is located on the upper face of the rigid floating body.

5. The ski boot according to claim 1, characterised in that the flexible tabs are arranged in pairs on opposite sides of the centerline of the longitudinal slit of the casing.

6. The ski boot according to claim 1, characterised in that the distal ends of each flexible tab is provided with a transversal through hole, which is engaged in a pass-through and free sliding manner by a corresponding section of the flexible cable.

7. The ski boot according to claim 1, characterised in that the flexible tabs are rigidly fixed to said casing inside the same casing.

8. The ski boot according to claim 1, characterised in that the flexible tabs are made of plastic material.

9. The ski boot according to claim 1, characterised by also comprising an inner liner with a soft and thermal-insulating structure, which is inserted inside the shell and is shaped so as to accommodate and protect at least the foot of the user; the rigid floating body being arranged resting against the upper part of said inner liner; the flexible tabs extending skimmed over the upper part of said inner liner.

10. The ski boot according claim 1, characterised in that said gaiter moreover is configured to rise along the leg of the user remaining under the cuff.

11. The ski boot according to claim 1, characterised in that the shell additionally comprises a longitudinal zipper that is configured to extend along said gaiter, from the area above the instep of the foot up to an upper opening of the same gaiter.

12. The ski boot according to claim 1, characterised in that said casing is made of plastic material or composite material.

* * * * *